United States Patent [19]

Hechler

[11] Patent Number: 4,480,543

[45] Date of Patent: Nov. 6, 1984

[54] ENCLOSED GRAVURE PRINTING MACHINE

[75] Inventor: Hatto Hechler, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 468,403

[22] Filed: Feb. 22, 1983

[30] Foreign Application Priority Data

Mar. 24, 1982 [DE] Fed. Rep. of Germany ..... 3210767

[51] Int. Cl.[3] ..... B41F 9/02; B41F 9/18

[52] U.S. Cl. ..... 101/152; 101/181

[58] Field of Search ..... 101/152, 153, 154, 179, 101/180, 181, 182, 183, 184, 220, 221, 222, 216, 219, 228

[56] References Cited

U.S. PATENT DOCUMENTS

| | | | |
|---|---|---|---|
| 703,189 | 6/1902 | Firm | 101/221 |
| 1,640,977 | 8/1927 | Brueshaber | 101/180 X |
| 1,738,323 | 12/1929 | Scott | 101/180 |
| 2,036,158 | 3/1936 | McGiehan | 101/178 X |
| 2,221,930 | 11/1940 | Stafford et al. | 101/182 X |
| 2,227,616 | 1/1941 | Wolf | 101/220 |
| 2,242,045 | 5/1941 | Scott et al. | 101/180 |
| 2,319,853 | 5/1943 | Durham | 101/416 R |
| 2,464,119 | 3/1949 | Dawson | 101/416 R |
| 2,651,992 | 9/1953 | Sauberlich | 101/416 R |
| 3,098,436 | 7/1963 | Hornberger | 101/152 |
| 3,594,552 | 7/1971 | Adamson | 101/181 X |
| 3,851,582 | 12/1974 | Saueressig et al. | 101/181 |
| 3,885,494 | 5/1975 | Saueressig | 101/152 |

FOREIGN PATENT DOCUMENTS

| | | | |
|---|---|---|---|
| 2262550 | 6/1976 | Fed. Rep. of Germany . | |
| 710906 | 6/1954 | United Kingdom | 101/216 |

*Primary Examiner*—J. Reed Fisher

*Attorney, Agent, or Firm*—Frishauf, Holtz, Goodman & Woodward

[57] ABSTRACT

A plurality of printing systems are stacked above each other to form a printing system tower assembly. Two such structures are provided, constructed in form of the mirror image. Each printing system, including a forme or gravure cylinder and a printing or impression cylinder, is closely associated with a drying chamber, within which hot-air dryers are located. The respective, stacked drying chambers are separated from each other by fire-resistant separating walls. A web is guided through the first printing system tower assembly and then, in similar manner, through the second mirror-image printing system tower assembly, to thereby permit prime and verso printing, in multi-color reproduction, without turning of the web. The dryers are energy-efficient since external radiation therefrom is effectively prevented due to their back-to-back positioning and construction.

18 Claims, 2 Drawing Figures

ENCLOSED GRAVURE PRINTING MACHINE

The present invention relates to a gravure printing machine, and more particularly to the type of printing machine which is capable of multi-color printing with inks which require rapid drying and which emit fumes, so that the printing systems should be enclosed within an essentially gas-tight housing.

BACKGROUND

Various types of multi-color gravure printing machines for continuous printing on webs have been proposed, in which the printing systems are enclosed within cabinets which are essentially gas-tight. The gas-tight housing surrounds a plurality of printing stations or printing systems which are located stacked above each other. The web is introduced from above into the uppermost printing station. The web passes the respective forme cylinders and then passes between two adjacent printing stations, in looped arrangement, for coursing through the entire housing structure. The freshly printed continuous web then is removed from the gas-tight housing at the lower back wall thereof.

During drying, and as the freshly printed subject matter is passed between the printing stations, the inks emit vapors which may be noxious and, additionally, lend themselves at times to chemical treatment and recyclcing for recovery of useful chemicals. Some of those inks use Toluol as a solvent, which should be prevented from escaping to the atmosphere.

It is difficult to adjust the individual ink metering blades, and the ink metering blade holders which operate in the respective printing stations. A gate or closure which is located on the front side of the tower formed by the vertically stacked printing machines is provided on which the respective blade adjustment elements, as well as the blades, may be secured. If it is necessary to exchange one of the gravure forme cylinders, the gate must first be opened and various components of the printing machine must be disassembled before access can be had to respective cylinders.

THE INVENTION

It is an object to improve printing machines in which a plurality of printing stations or printing systems are contained within an essentially gas-tight housing, which accessibility to the parts and components is facilitated, and which is easily constructed and then maintained. Additionally, prime and verso printing should be possible without turning over a continuous substrate web, and the machine should operate efficiently with respect to use of drying energy.

Briefly, a plurality of fire-resistant separating walls are located within an essentially gas-tight housing, separating the housing into a plurality of chambers. The housing includes ink drying means, located therein, applying heat against the freshly printed side of the web, so that, during ink transfer upon printing at the respective stations, undesirable vapors which are released will be retained within the cabinet. The printing systems in the housing, the fire-resistant separating walls, and the ink drying means form a first printing system assembly. A second printing system assembly is provided, forming the mirror image of the first, and located back-to-back with respect thereto. The back sides of the drying chambers are located against each other—which saves energy due to lesser radiation to the outside—and guide rollers are located in the cabinet of the first one of the printing stations guiding the web, which has the prime side printed, to the other printing station assembly for printing on the reverse side.

The system has the advantage that little heat is lost by radiation, the printing systems including the forme cylinder and the ink metering blades can be located at the exposed sides for ready accessibility, and continuous prime and verso printing can be carried out on the substrate web.

DRAWINGS

FIG. 1 is a schematic side view of the arrangement of vertically stacked printing stations or systems for printing on one side of a continuous web, for example for printing the prime side; and FIG. 2 illustrates the arrangement for printing on the verso side, which, for example, can be located at the left side of the prime printing system assembly shown in FIG. 1.

DETAILED DESCRIPTION

Figure 1:
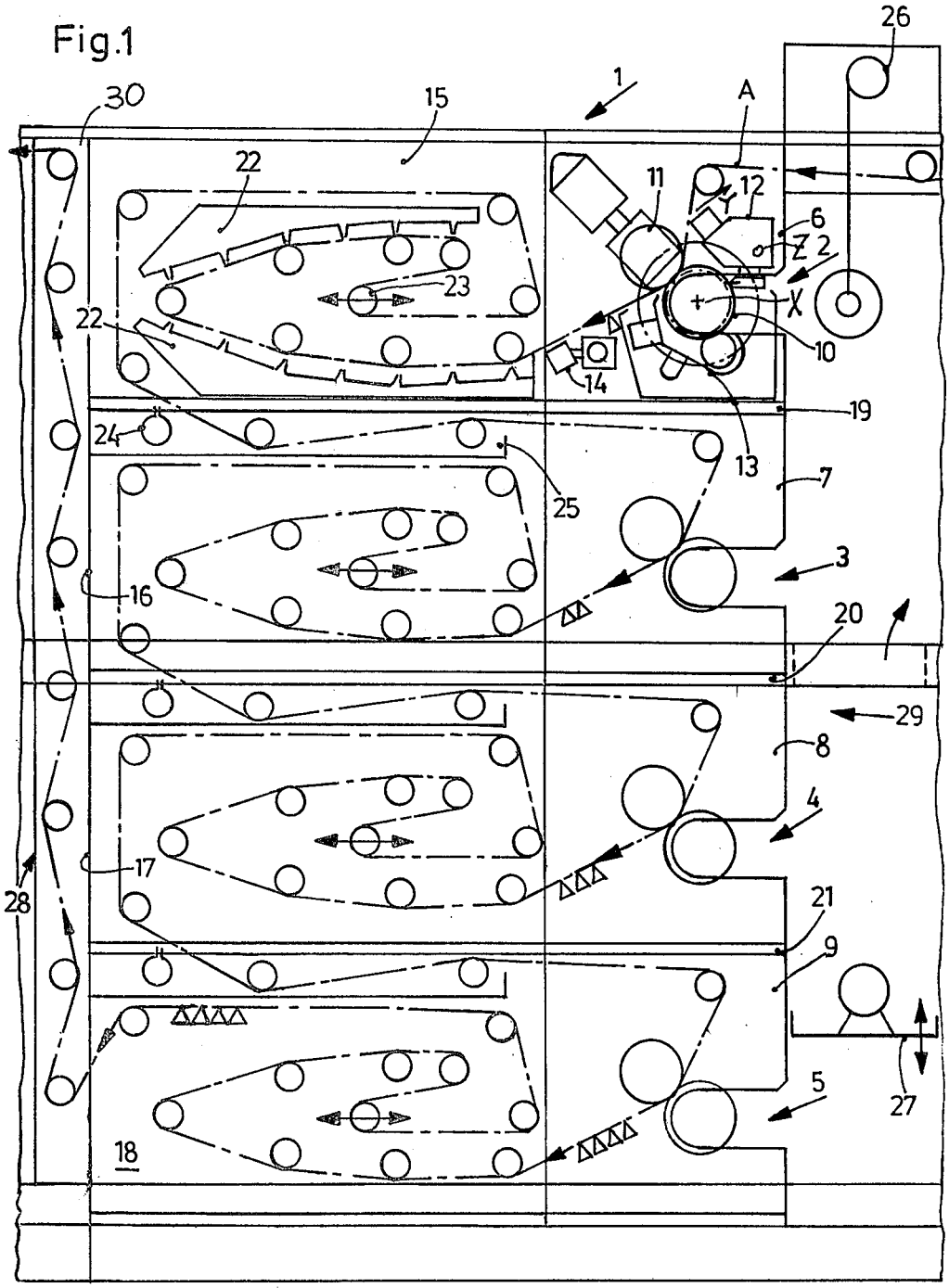

A vertically stacked assembly, for example in form of a tower 1, is provided to print on a continuous substrate web A with four colors. The tower 1 retains four vertically stacked printing stations 2, 3, 4, 5. Side walls 6, 7, 8, 9, for example made of cast material, are provided for retaining thereon gravure cylinders 10 and impression cylinders 11 which, by a contact pressure arrangement as well known, for example a hydraulic cylinder-piston pressure arrangement, the web A can be pressed against the gravure cylinder 10. A blade holder rail structure 12 is secured in the side walls, and positioned to be located above the center of rotation of the forme cylinders. The details are shown only with respect to the top printing station 2, the printing stations 3 to 5 being identical thereto. The side walls 6 thus retain the blade rail 12. The blade rail 12, together with the blades thereon, can be tipped upwardly so that the forme or gravure cylinder 10 can be easily exchanged. An ink trough 13, into which the gravure cylinder 10 dips, is provided, as is customary and well known in accordance with printing systems of this type.

Cylinder 10 rotates in counter-clockwise direction. Its axis of rotation is shown at X, and the blade holding rail and blade mechanism can be moved in the direction of the arrow Y about a pivot point Z. Of course, another arrangement, such as a lifting and sliding removal arrangement, is also possible.

The substrate web A is guided for printing between the printing or forme cylinder 10 and the impression cylinder 11 to a scanner 14 which provides the scanning signal for control of the register, or, for example, for readjustment of the web path, as well known. The scanner may, for example, be an opto-electronic sensor, and scans a test marker or other suitable point on the printed substrate for determination of register. After having passed scanner 14, the web is guided into a dryer chamber 15. In contrast to the massive cast iron side walls 6–9, the dryer chambers 15, 16, 17 and 18 are made of a steel construction, for example a steel frame (not shown) with sheet steel side walls.

A fire-resistant or fire-retardant, preferably fire-proof separating wall 19 is located between the dryer chambers 16 and 17; similarly, fire-proof or fire-retardant walls 20, 21 are located between the other, stacked chambers. The entire construction, then, will be highly energy efficient since the effect of attached housing or attached chambers is used to prevent radiation from the individual dryer chambers to the surrounding area. The fire-resistant separating walls 19–21 substantially contribute to operating safety.

The continuous web A is guided over a plurality of paper guide rollers, as well known, in form of a loop, for drying of the freshly printed ink by a hot-air dryer 22. Preferably, the last one of the paper guide rollers, namely guide roller 23, is adjustable, so that the register can be suitably set or controlled. All other dryer rollers within the chamber 15 may be fixed. The movable roller 23, as schematically indicated by the double arrow, is moved back and forth to control the register of printing, for example under control of a servo motor which, in turn, is controlled by the scanner 14. The scanning and register control system may be in accordance with any suitable construction, as well known.

After drying, the web A leaves the chamber 15 and is guided through a slit within the fire-proof or fire-resistant wall 19 into the dryer space of the printing station 3. Preferably, a web dampening unit 24 is provided, for example in form of a mist dispenser or the like, located above a moisture or condensate trough 25. The web A thus is first slightly damped and guided over the condensate trough 25 for introduction into the second printing station 7. Printing station 3, as noted, is essentially identical to printing station 2, and printing is effected on the web A which, then, is dried in similar manner in the dryer chamber 16; thereafter, the web is guided through the printing stations 4 with dryer chamber 17 and the printing station 5 with dryer chamber 18. Thus, four printing images are applied to the prime side of the web in the printing stations, one above the other, in form of a printing tower.

Figure 2:
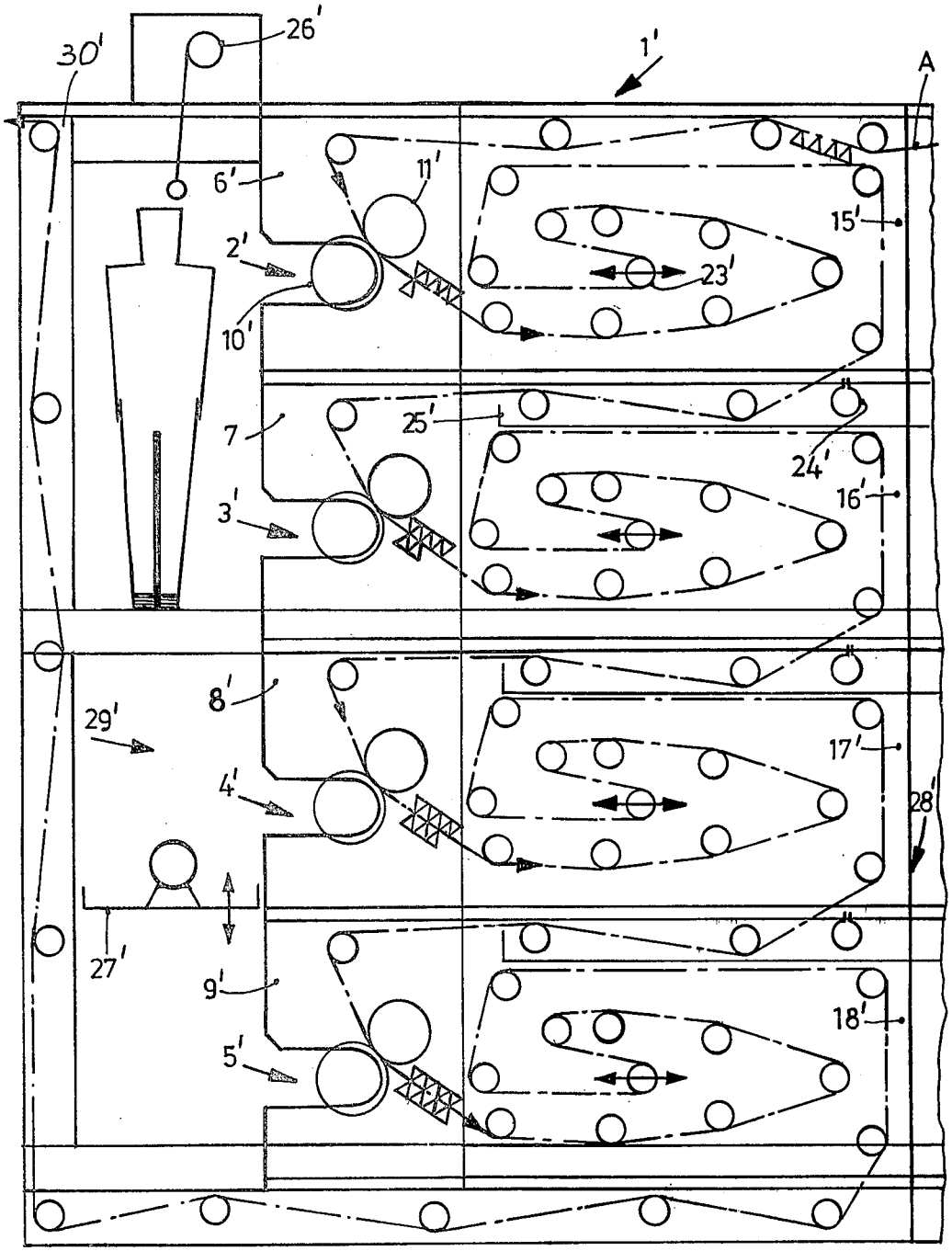

Preferably, a second tower, and constructed essentially identically to the tower 1, but the mirror image thereof, is provided. This tower—see FIG. 2—is located back-to-back with respect to the tower of FIG. 1. Tower 1'—FIG. 2—is provided to apply four-color printing images on the verso side of the web. For simplicity, the same reference numerals have been used in FIG. 2 as in FIG. 1, but with a prime notation, and will not be explained again.

The printing stations 1, 1' are preferably located immediately adjacent each other, which additionally contributes to energy efficiency since radiation of heat from the dryers to the outside is essentially prevented, and any insulation need be applied only against the side walls, typically of sheet steel, of the respective drying chambers. The web A is guided within essentially hermetically closed structures, so that emission of vapors, for example Toluol vapors, into the free atmosphere is prevented.

Locating the towers 1, 1' next to each other, and constructing them to be in respective mirror image, has the additional advantage that, first, the substrate web A can be guided through the tower 1 from the top downwardly, and, in the next, mirror-image printing station A, again from the top downwardly without having to turn the web. The arrangement of the blade rails 12, above the center of rotation of the respective forme cylinders, and particularly when constructed for tipping movement, insures easy accessibility and replacement of the respective gravure cylinders 10. These cylinders may be quite large and thus heavy. For easy replacement, the construction, in accordance with a feature of the invention, provides for a hoist 26 located on the front side, that is, on the operating side, of the tower 1. A similar hoist 26' is preferably provided on the operating side of the tower 1'. Additionally, a vertically adjustable platform 27, 27' is located at the front side, vertically movable, for example under power operation, in order to permit an operator ready access for service of the respective printing stations.

The assemblies of the printing stations, with the dryer chambers 15–18, 15'–18', can be placed against each other so that the back walls 28, 28 are in contact with each other.

As can be seen, the guidance of the web between the towers 1, 1' requires only slight modification of the printing station structures, so that castings and other shaping of metal parts for any one printing station can be used for all of them. The back walls of the drying chambers 15–18 have another and narrow guidance chamber 30 attached thereto, the side walls of which retain respective guide rollers to guide the printed web from the last drying chamber 18 upwardly, in suitably stretched condition, for example as shown, to an inlet above the top chamber 15' of the assembly 1', where the inlet structure can be similar to that of the inlet structure in the chambers 16', 17', 18', with only minor modifications of cutting in the back wall 28'. Likewise, an outlet guide chamber 30', located at the front or operator side 29', can be provided, which, however, may require only a lesser number of guide rollers than the guide rollers within chamber 30, opposite the operator side 29 of the assembly 1, since the web already has been finished-printed, and stretching of the web between succeeding printing stations is no longer needed.

The platform 27, if used, of course can also be utilized to hoist different cylinders, as schematically shown in the drawings.

Various changes and modifications may be made within the scope of the inventive concept. For example, suitable air locks, or the like, can be provided located adjacent inlet and outlet openings through which, and from which, the web A is introduced into the printing power stations, and removed therefrom. Such air locks may, for example, include vacuum plates located closely adjacent both sides of the web, to float the web on a cushion of air drawn in by vacuum pumped out from openings or grooves in the plates, and leaking in through narrow slits on both sides of the web, to atmospherically isolate the interior of the respective chambers 15–18, 15'–18' and the printing stations from ambient ambient atmosphere.

I claim:

1. Multi-color gravure web printing machine for continuous prime and verso printing on a web (A) and utilizing ink which is subject to emission of vapors comprising the combination of a first essentially gas-tight upright housing forming a first tower housing structure (1) having a back wall;

a first plurality of printing systems (2, 3, 4, 5) positioned above each other and forming a first tower located within the tower housing structure;

a first plurality of essentially horizontally placed fire-resistant separating walls (19, 20, 21) separating the first tower housing structure into a plurality of chambers (15–18);

ink drying means (22) located in the chambers and positioned adjacent the back wall, and laterally with respect to the printing systems, whereby, upon drying of ink after printing in the respective systems, vapors are released;

the tower housing structure, the printing systems, the ink drying means, and the fire-resistant separating walls forming a first printing system tower assembly, with a second printing system tower assembly, similar to said first printing system tower assembly, and positioned back-to-back with respect to said first printing system tower assembly, in which the relative positions of the ink drying means and the printing systems are arranged in mirror-image relation with respect to the first assembly, the ink drying means being located in the chambers of the respective tower assemblies, upon placement of the tower assemblies back-to-back, such that the ink drying means will be adjacent each other and the printing systems remote from each other to be positioned at outer sides of the combination of back-to-back tower assemblies;

and means for guiding a continuous web (A) of printing substrate through the first printing system tower assembly from an upper printing system in a vertically progressing path between an upper printing system and a lower printing system of the vertically located printing systems for printing on the prime side of the web, then guiding said continuous web towards an upper printing system of the second printing system tower assembly, and then guiding the continuous web in a generally vertically progressing path between an upper printing system and a lower printing system of the vertically located printing systems of the second printing tower assembly for verso printing on said continuous web of printing substrate.

2. Printing machine according to claim 1, wherein each printing system (2, 3, 4, 5) includes a printing or forme cylinder (10) and a blade holder rail structure (12);

and wherein the blade holder rail structure is pivotally secured in the respective printing station for pivoting about a pivot axis (Z) which is located above the axis of rotation of the printing or forme cylinder (10) by a sufficient distance to permit rolling removal of the printing cylinder without disassembly of the blade holder rail structure.

3. Printing machine according to claim 2, wherein each one of the printing systems includes a side wall (6, 7, 8, 9) at the outer sides of the respective printing or forme cylinders;

and the blade holder rail structure (12) is pivotally secured in said side walls.

4. Printing machine according to claim 2, further including a lifting platform (27) located adjacent the printing or forme cylinders and vertically movable in a direction parallel to the axes of said printing or forme cylinders.

5. Printing machine according to claim 2, further including a lifting hoist (26) located in alignment with a theoretical plane passing through the axes of rotation of the printing or forme cylinders of said vertically positioned printing systems capable of lifting removal of the gravure or forme cylinders of the respective printing systems.

6. Printing machine according to claim 1, wherein the printing systems each include a chamber structure laterally placed along the fire-resistant separating walls;

and cast-iron side walls (6–9) located adjacent the drying chambers, said cast-iron side walls retaining printing cylinders (10, 11) of said printing systems.

7. Printing machine according to claim 1, further including a register scanning device (14) associated with each printing system.

8. Printing machine according to claim 7, wherein the printing systems include a gravure or forme cylinder (10) positioned—with respect to the path of the web—in advance of the chambers;

and wherein the register device (14) is located between the respective gravure or forme cylinder and the chamber including the ink drying means therein.

9. Printing machine according to claim 7, further including a plurality of web guide rollers located within said chambers;

and wherein one of said rollers is position-adjustable with respect to the path of travel of the web in the chamber under control of the register device (14).

10. Printing machine according to claim 1, further including a web damping apparatus (24) and a condensate trough (25) located in at least one of the chambers.

11. Printing machine according to claim 10, wherein the damping device and the condensate trough are located inside the chambers adjacent an inlet thereto positioned in the path of the web in the initial portion of its passage through the respective printing system.

12. Printing machine according to claim 1, wherein the means for guiding the continuous printing substrate from a lower printing system of the first printing system tower assembly to an upper printing system of the second printing system tower assembly comprises a web guide chamber (30) located between the first and the second printing system tower assemblies and guiding the web from a lower one (17, 18) of said chambers of one of said system tower assemblies to an oppositely positioned higher one of the chambers (15', 16') of the second printing tower assembly.

13. Printing machine according to claim 1, further including a vertically movable lifting platform (27) located adjacent the outer side of each one of the printing tower assemblies.

14. Printing machine according to claim 1, further including a lifting hoist (26) located adjacent the outer side of each one of the printing station assemblies capable of lifting removal of printing cylinders forming part of the respective printing systems.

15. Printing machine according to claim 13, further including a lifting hoist (26) located adjacent the outer side of each one of the printing station assemblies capable of lifting removal of printing cylinders forming part of the respective printing systems.

16. Printing machine according to claim 12, further including a vertically movable lifting platform (27) located adjacent the outer side of each one of the printing tower assemblies.

17. Printing machine according to claim 12, further including a lifting hoist (26) located adjacent the outer side of each one of the printing station assemblies capable of lifting removal of printing cylinders forming part of the respective printing systems.

18. Printing machine according to claim 16, further including a lifting hoist (26) located adjacent the outer side of each one of the printing station assemblies capable of lifting removal of printing cylinders forming part of the respective printing systems.

* * * * *